US005170535A

United States Patent [19]

Strong

[11] Patent Number: 5,170,535

[45] Date of Patent: Dec. 15, 1992

[54] TIME SAVING PAPER CLIPS

[76] Inventor: Billie E. Strong, 5275 Davis Rd., Midpines, Calif. 95345

[21] Appl. No.: 830,927

[22] Filed: Feb. 4, 1992

[51] Int. Cl.[5] ..... B42F 1/00; G09F 3/00

[52] U.S. Cl. ..... 24/67.9; 24/67 R; 24/547

[58] Field of Search ..... 24/67.9, 67 R, 67 AR, 24/545, 546, 547, 549, 90 HA

[56] References Cited

U.S. PATENT DOCUMENTS

| | | | |
|---|---|---|---|
| 1,418,306 | 6/1922 | Holt | 24/547 |
| 1,516,294 | 11/1924 | Hubeny et al. | 24/547 |
| 1,783,484 | 12/1930 | Ross | 24/67.9 |
| 2,055,152 | 9/1936 | Larson | 24/547 |
| 2,781,566 | 2/1957 | Hammer | 24/67.9 |
| 2,815,595 | 12/1957 | Davis | 24/67 AR |
| 2,823,479 | 2/1958 | Zdanowski | 24/90 HA |
| 3,225,469 | 12/1965 | Chase | 24/67.9 |
| 3,408,700 | 11/1968 | Chase | 24/67.9 |
| 3,913,181 | 10/1975 | Walker | 24/67.9 |
| 4,237,587 | 12/1980 | Hsiao et al. | 24/67.9 |
| 4,286,358 | 9/1981 | Lenin | 24/67.9 |
| 4,300,268 | 11/1981 | Wilson | 24/67.9 |
| 5,022,124 | 6/1991 | Yiin | 24/67.9 |

FOREIGN PATENT DOCUMENTS

| | | | |
|---|---|---|---|
| 0444860 | 5/1927 | Fed. Rep. of Germany | 24/547 |
| 1128624 | 1/1957 | France | 24/67.9 |
| 0281894 | 12/1927 | United Kingdom | 24/67.9 |

*Primary Examiner*—Victor N. Sakran
*Attorney, Agent, or Firm*—Leon Gilden

[57] ABSTRACT

An improved paper clip is provided with an extra loop of wire so that the clip can be used from either end to attach papers together. Modifications include providing the clip with serrated gripping edges, bend points and adhesively attachable labels.

2 Claims, 4 Drawing Sheets

TIME SAVING PAPER CLIPS

BACKGROUND OF THE INVENTION

1. Field of the Invention

The present invention relates to office supplies and more particularly pertains to an improved paper clip construction.

2. Description of the Prior Art

There is a plethora of different designs for paper clips. In its most ubiquitous form, a paper clip is a wire device formed of internesting elongate wire loops with a single loop facing in one direction and a pair of nesting loops facing in the other direction. A good example of such a well known paper clip style is shown in FIG. 1 of U.S. Pat. No. 4,237,587 which issued to Hsiao et al. on Dec. 9, 1980. In reviewing this standard form of paper clip, it will be noted that only one end of the clip can be utilized to clip pieces of paper together. As such, when a paper clip is removed by a worker for the purpose of clipping sheets of paper together, the worker must first determine the correct end of the clip and align it accordingly. This greatly increases the task of clipping sheets of paper together, both in time and effort, and accordingly, there exists a continuing need for new and improved paper clips which could be more easily aligned and utilized in performing this simple office function. In this respect, the present invention substantially fulfills this need.

SUMMARY OF THE INVENTION

In view of the foregoing disadvantages inherent in the known types of paper clips now present in the prior art, the present invention provides an improved paper clip construction wherein the same can be utilized from either end to clip sheets of paper together. As such, the general purpose of the present invention, which will be described subsequently in greater detail, is to provide a new and improved paper clip construction which has all the advantages of the prior art paper clips and none of the disadvantages.

To attain this, the present invention essentially comprises an improved paper clip which is provided with an extra loop of wire so that the clip can be used from either end to attach papers together. Modifications include providing the clip with serrated gripping edges, bend points and adhesively attachable labels.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved paper clip which has all the advantages of the prior art paper clips and none of the disadvantages.

It is another object of the present invention to provide a new and improved paper clip which may be easily and efficiently manufactured and marketed.

It is a further object of the present invention to provide a new and improved paper clip which is of a durable and reliable construction.

An even further object of the present invention is to provide a new and improved paper clip which is susceptible of a low cost of manufacture with regard to both materials and labor, and which accordingly is then susceptible of low prices of sale to the consuming public, thereby making such paper clips economically available to the buying public.

Still yet another object of the present invention is to provide a new and improved paper clip which provides in the apparatuses and methods of the prior art some of the advantages thereof, while simultaneously overcoming some of the disadvantages normally associated therewith.

Still another object of the present invention is to provide a new and improved paper clip which can be utilized from either of its ends to hold sheets of paper together.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 3:
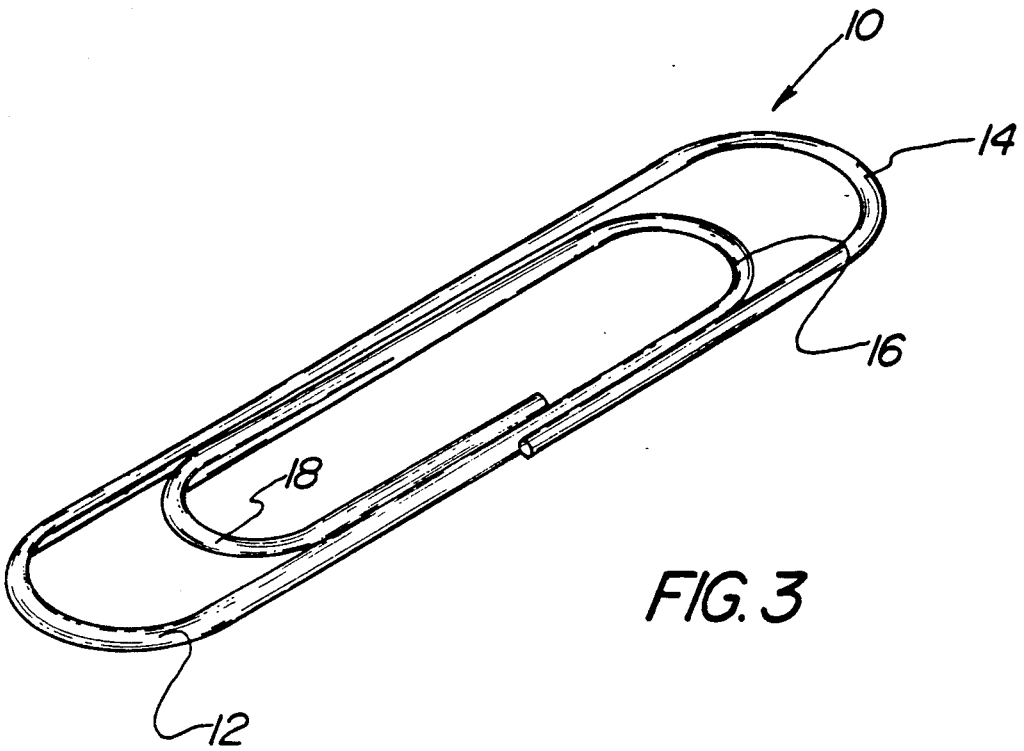
FIG. 3 is a perspective view of a first embodiment of the present invention.
Figure 4:
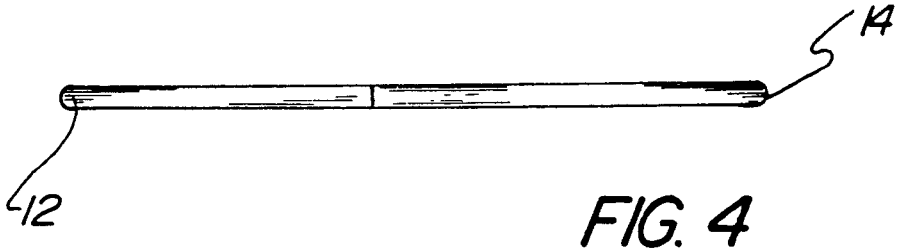
FIG. 4 is a side elevation view thereof.
Figure 5:
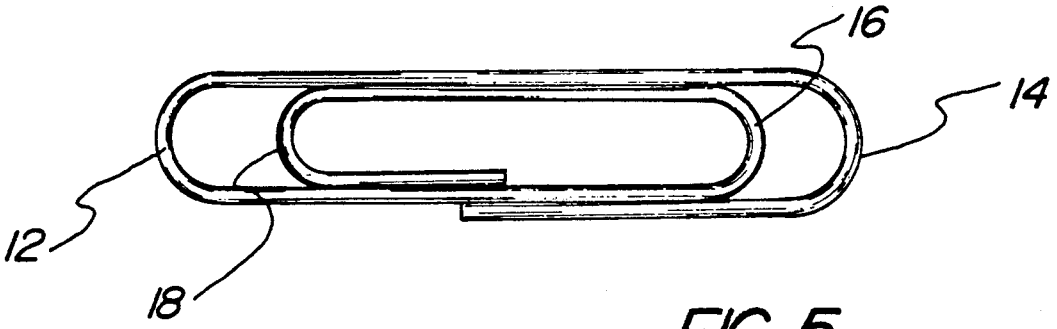
FIG. 5 is a top plan view thereof.

With reference now to the drawings, and in particular to FIGS. 3, 4 and 5 thereof, a first embodiment of a new and improved paper clip embodying the principles and concepts of the present invention and generally designated by the reference numeral 10 will be described.

Figure 1:
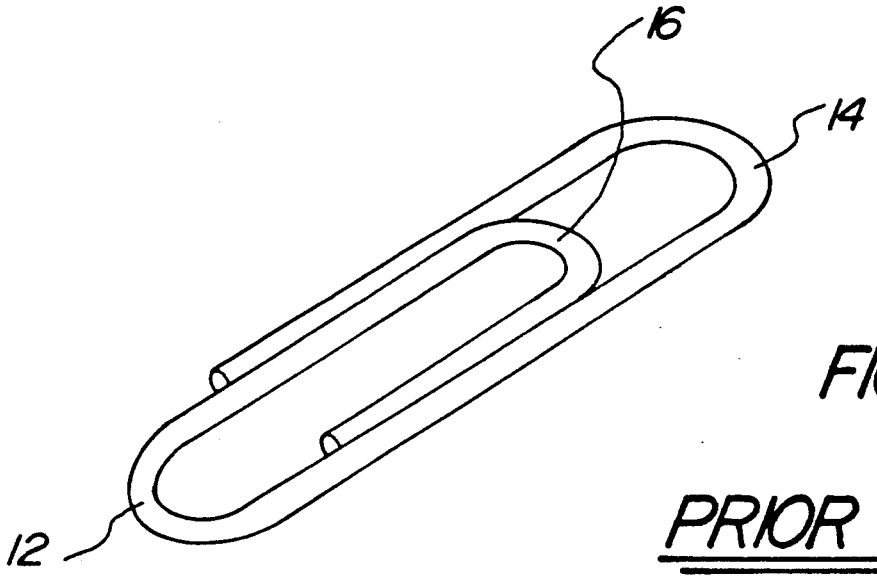
FIG. 1 PRIOR ART
FIG. 1 is a perspective view of a prior art paper clip.
Figure 2:
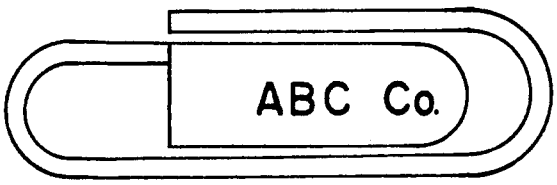
FIG. 2 PRIOR ART
FIG. 2 is a front elevation view of another prior art paper clip.

Initially however, reference is made to FIGS. 1 and 2 of the drawings wherein prior art paper clips are illustrated. The paper clip shown in FIG. 1 is the ubiquitous form of the clip over which the present invention comprises a substantial improvement. As shown, this paper clip includes a first end 12 consisting of a single wire loop and a second end 14 having an internested loop 16. As is well known by those who utilize paper clips, only the end 14 of the clip shown in FIG. 1 can be utilized to clip papers together since both of the wire loops 14, 16 are required to grasp overlying sheets of paper. The end 12 cannot be utilized since a second loop is not available for positioning on opposed sides of a sheath of papers. Accordingly, before the paper clip shown in FIG. 1 can be utilized, it must be aligned so that the end 14 points toward the papers to be clipped together, and this often results in a very time consuming operation.

FIG. 2 of the drawings illustrates a prior art paper clip of the type shown in U.S. Pat. No. 4,286,358 which issued to Gary Levin on Sep. 1, 1981. This paper clip provides the dual function of being utilized to clip papers together and also serves as a labeling or advertising means. Both of the paper clips illustrated in FIGS. 1 and 2 represent the current state of the art over which the present invention comprises a substantial improvement.

As shown in FIGS. 3, 4 and 5, the paper clip 10 comprising the present invention includes the aforedisscussed wire loops 12, 14, 16, and further includes an extension of the loop 16 into a continuous further loop 18 that is internested within the loop 12. As such, this basic embodiment of the present invention provides for wire loops 12, 18 at one end and loops 14, 16 at the other end, whereby either end of the paper clip 10 can now be utilized to clip sheets of paper together. As such, a user of the paper clip 10 need not initially align the paper clip with the correct end pointing toward the sheath of papers inasmuch as either end can now be utilized.

Figure 6:
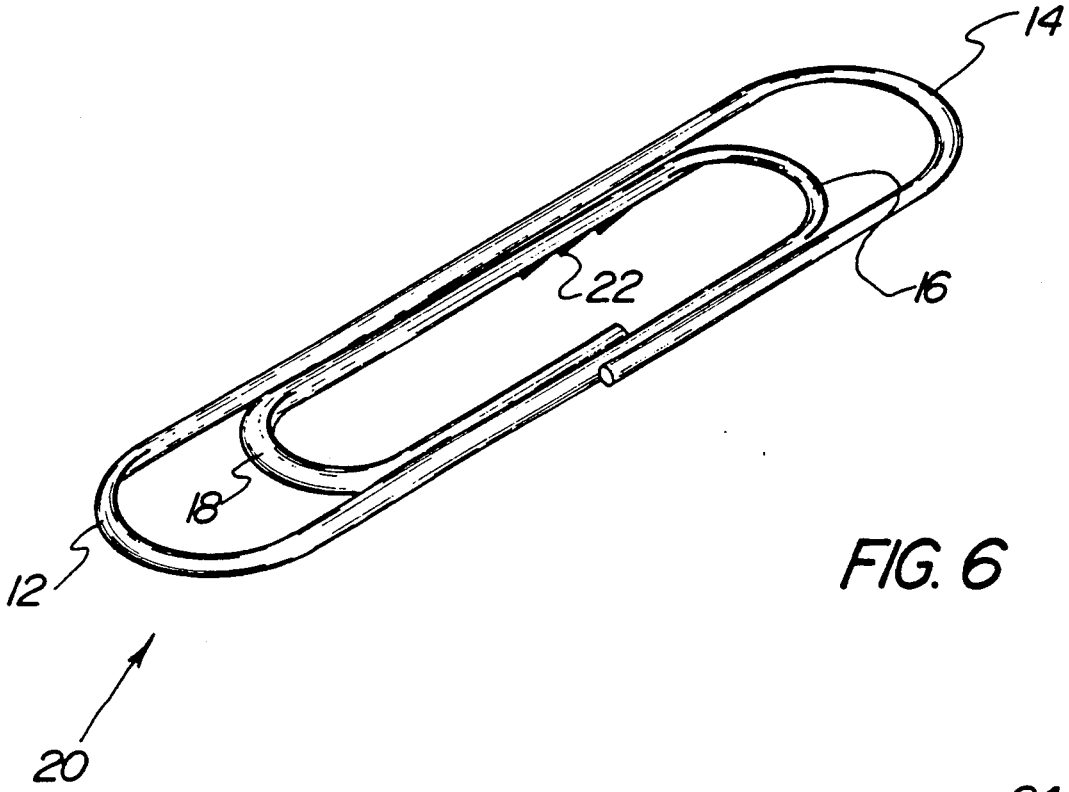
FIG. 6 is a perspective view of a second embodiment of the present invention.

FIG. 6 of the drawings illustrates a modified embodiment of the present invention which is generally designated by the reference numeral 20. In this embodiment 20, at least one wire loop 16 is provided with a serrated edge 22 comprising a plurality of gripping teeth. With the wire loop 16 overlying a sheath of papers and the loop 14 being positioned beneath the papers, the gripping teeth 22 prevent the paper clip 20 from becoming unintentionally disengaged therefrom.

Figure 7:
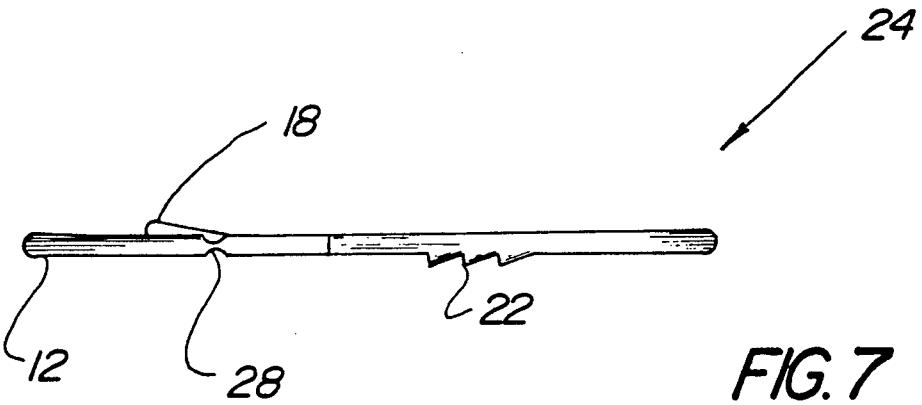
FIG. 7 is a side elevation view of a third embodiment of the present invention.
Figure 8:
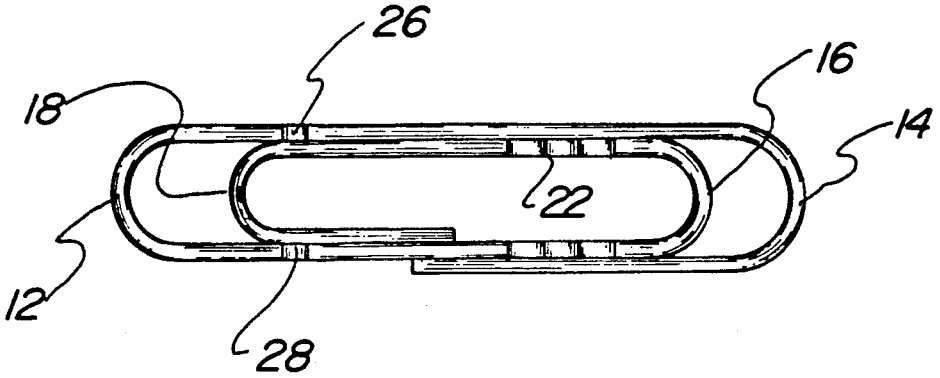
FIG. 8 is a top plan view of the third embodiment of the invention.

FIGS. 7 and 8 illustrate a third embodiment of the present invention which is generally designated by the reference numeral 24. This embodiment is similar in all respects to the embodiment shown in FIG. 6 with the exception that the wire loop 18 is turned upwardly as best illustrated in FIG. 7 whereby the two loops 12, 18 no longer lie in the same horizontal plane. This configuration provides for a guided movement of the end 12 of the clip 24 to thus allow papers to be more easily aligned between the two loops 12, 18. Additionally, narrowed portions 26, 28 are disclosed on the wire loop 12, thus to facilitate a selective bending of this loop downwardly if desired. This increases the angle between the planes of the wire loops 12, 18 so as to provide an even larger paper receiving opening to assist in the utilization of this embodiment 24 of the invention.

Figure 9:
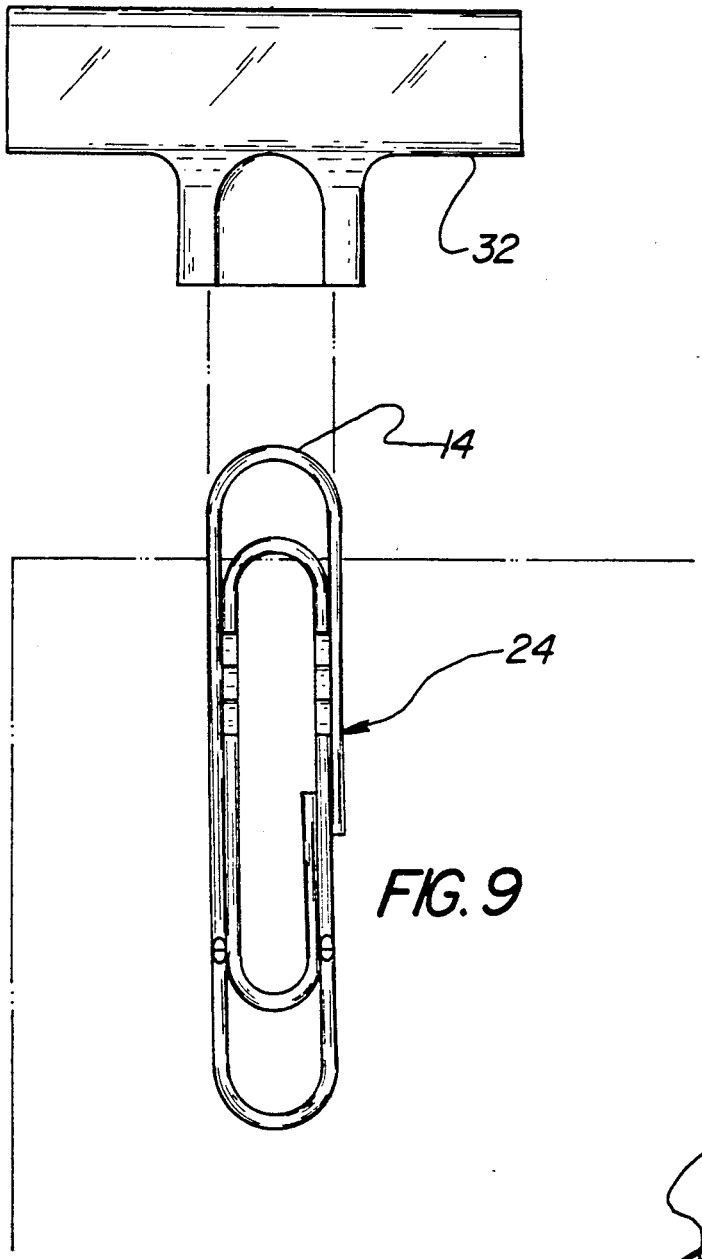
FIG. 9 is a front elevation view of a fourth embodiment of the invention.
Figure 10:
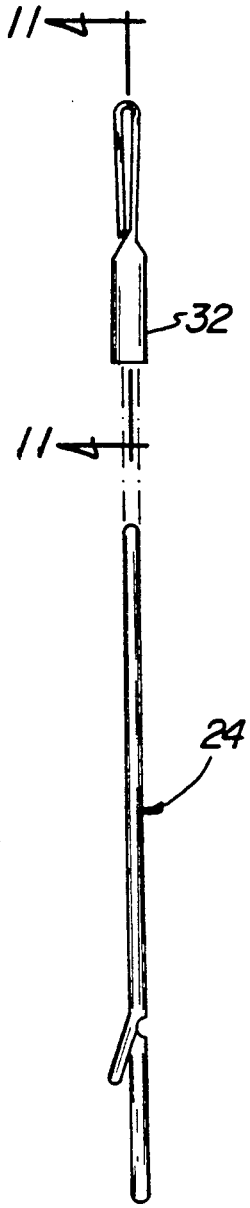
FIG. 10 is a side elevation view of the fourth embodiment of the invention.
Figure 11:
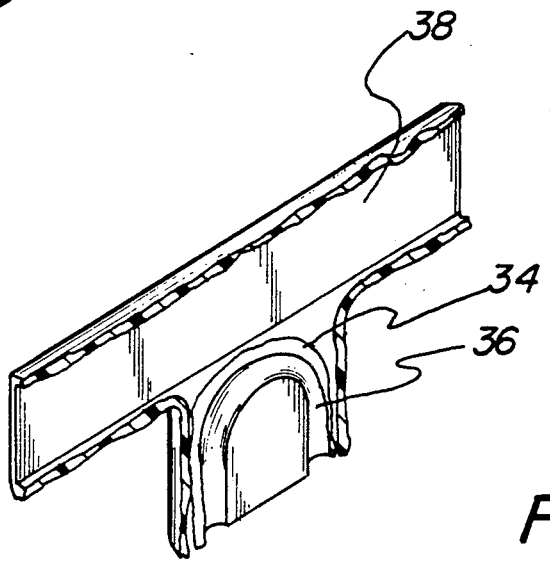
FIG. 11 is a cross-sectional view of the invention as viewed along the line 11—11 shown in FIG. 10.

FIGS. 9, 10 and 11 illustrate a fourth embodiment of the invention which is generally designated by the reference numeral 30. In this embodiment, the paper clip 24 is utilized in combination with a T-shaped label 32 positionable over the loop 14. As best illustrated in FIG. 11, a flexible, rupturable glue pouch 34 is positioned within the cavity 36 designed to receive the wire loop 14, and the forced positioning of this wire loop within the cavity results in a rupturing of the glue pouch so as to firmly affix the label 32 to the paper clip 24. This embodiment 30 of the invention allows a paper clip to provide the dual function of clipping sheets of paper together while also being utilized as a labeling means. As is apparent, the cavity 38 forming a part of the T-shaped label 32 is designed to receive a card having pertinent information imprinted thereon. The card is slidably positionable within the cavity 38 in a now well understood manner.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved paper clip having first and second ends, said first end including first and second internested loops positionable on opposed sides of said paper, said second end including third and fourth internested loops positionable on opposed sides of said paper, whereby said first or second end of said paper clip facilitates a conventional use thereof, said paper clip further including a serrated edge on at least one of said first, second, third and fourth internested loops, said paper clip further including grooves to facilitate a bending of said paper clip, said grooves being oppositely disposed and aligned on at least one of said first, second, third and fourth internested loops, said paper clip further including an offset angulation on at least one of said first, second, third and fourth internested loops, whereby an easier positioning of said paper clip over said paper is facilitated, said paper clip further including a removable label attachable to at least one of said first, second, third and fourth internested loops, said label including a pressure rupturable adhesive-containing pouch positioned within a paper clip receiving slot on said label, said paper clip being operable to rupture said adhesive-containing pouch upon an insertion of said paper clip into said slot, whereby at least one of said first, second, third and fourth internested loops may be permanently adhesively attached to said label.

2. The new and improved paper clip as described in claim 1, and further wherein said paper clip receiving slot is curvilinearly-shaped to match an existing end shape of said paper clip, said adhesive-containing pouch being similarly curvilinearly-shaped to match said end shape of said paper clip, thereby to provide a means of utilizing an exact predetermined amount of said adhesive whereby a particular internested loop may be provided with adhesive at all areas of contact with said label without excess adhesive being discharged from said slot.

* * * * *